US005975663A

United States Patent [19]

Becker

[11] Patent Number: 5,975,663

[45] Date of Patent: Nov. 2, 1999

[54] ARTICULATING HINGE COVERING DOOR STOP

[75] Inventor: Theodore A. Becker, Cleveland, Tenn.

[73] Assignee: Maytag Corporation, Newton, Iowa

[21] Appl. No.: 09/105,019

[22] Filed: Jun. 25, 1998

[51] Int. Cl.[6] ..... A47B 96/04

[52] U.S. Cl. ..... 312/405; 312/329; 16/374; 49/397

[58] Field of Search ..... 16/374, 377; 312/401, 312/405, 326, 329, 138.1; 49/397, 399

[56] References Cited

U.S. PATENT DOCUMENTS

| | | | |
|---|---|---|---|
| 2,720,674 | 10/1955 | Horvay . | |
| 2,845,320 | 7/1958 | Saunders et al. . | |
| 2,866,675 | 12/1958 | Kesling | 312/405 |
| 2,955,315 | 10/1960 | Squire et al. . | |
| 3,452,387 | 7/1969 | Jerila et al. . | |
| 3,597,174 | 8/1971 | Patton et al. | 16/221 X |
| 4,151,681 | 5/1979 | Roberts . | |
| 4,428,096 | 1/1984 | Kaspar | 16/374 X |
| 4,609,234 | 9/1986 | Naniwa et al. | 312/296 |
| 4,696,412 | 9/1987 | McGowan et al. | 16/374 X |
| 5,040,857 | 8/1991 | Mandel et al. . | |
| 5,187,837 | 2/1993 | Gunderson et al. . | |
| 5,265,954 | 11/1993 | Keil . | |
| 5,522,656 | 6/1996 | Jenkins | 312/405 X |

FOREIGN PATENT DOCUMENTS

| | | | |
|---|---|---|---|
| 677576 | 3/1930 | France | 16/377 |

*Primary Examiner*—Jose V. Chen
*Assistant Examiner*—Hanh V. Tran
*Attorney, Agent, or Firm*—Everett G. Diederiks, Jr.

[57] ABSTRACT

The permissible degree of opening of a cabinet door is limited by the interengagement between a cover member for an upper door hinge and abutment structure carried by the door itself. In a preferred embodiment, the abutment structure is defined by another cover member that is secured upon an upper portion of the door. The hinge cover member is provided with a tab that projects into a cavity or recessed section of the door cover member and a portion of this projecting tab is directly engaged by a portion of the door cover member to limit the permissible angular door movement. Furthermore, the hinge cover member is preferably mounted for movement relative to the cabinet. In the preferred embodiment, the hinge cover member is pivoted in direct response to engagement with the first abutment portion of the door cover member and the door is prevented from further pivotal movement when the first abutment portion of the door cover member engages a stop portion defined by the projecting tab of the hinge cover member.

20 Claims, 2 Drawing Sheets

61
69
108
66
98
95
70
72
152
148
102
104
85
154
93
157
100
88
106
91
144
117
111
122
125
124
1
132
114
128
120
125
123
62
35
5
138
33
141
21
52
31
30
48
32
34
-8-
39
36
53
43
38
2
40
58
27
28
45
57
29
-12-
41
-18-
25

ARTICULATING HINGE COVERING DOOR STOP

BACKGROUND OF THE INVENTION

1. Field of the Invention

The present invention pertains to the art of cabinets wherein access to an interior compartment of the cabinet is provided by opening a pivotally mounted door and, more particularly, to a cover assembly for at least an upper hinge unit used to pivotally mount the door, which cover assembly also functions to limit the degree of opening of the door.

2. Discussion of the Prior Art

In the art of cabinets, it is extremely common to provide access to one or more compartments defined within a cabinet by pivotally mounting a door for movement between open and closed positions upon the cabinet. For example, a refrigerator cabinet will include one or more doors which are pivotally mounted through hinge assemblies that define generally vertically extending pivot axes such that the door(s) can be readily shifted relative to walls of the cabinet to provide selective access to interior fresh food and/or freezer compartments. In a typical refrigerator cabinet arrangement, an upper hinge is provided that includes a first portion fixed at a top wall of the cabinet and a second, hinge axis defining portion that is connected to an upper portion of the door and about which the door can rotate. Because such an upper hinge is generally, readily visible, it has become common to fix a cover atop the cabinet that simply extends over the first and second hinge portions for aesthetic purposes.

In many instances in the art of cabinets, it is desirable to limit the degree to which a cabinet door can pivot open, whether it be for the sake of convenience in enabling the door to be readily closed, to protect an object positioned adjacent the cabinet, to prevent direct damage to the door or otherwise. In the art of refrigerators, limiting door movement can be of particular concern since a typical refrigerator door is generally provided with item supporting shelves and therefore the door can be quite heavy such that a fair amount of momentum can be developed if the door is permitted to swing open an overly unrestricted amount. For at least these reasons, it has also been heretofore proposed to provide stop arrangements for limiting the angular degree to which cabinet doors can open. Such known stop arrangements have generally taken the form of either fixed abutment members which are directly engaged by the door upon a predetermined degree of opening or elements which tend to bias the door closed with increasing force as the door is progressively opened. Unfortunately, these known stop arrangements simply add to the cost of the overall cabinet, can be rather complex in nature and actually detract from the overall aesthetics of the cabinet.

Therefore, there exists a need in the art of cabinets for a stop arrangement for limiting the degree to which a cabinet door can be pivoted which is simple in construction and has an associated cost factor that is greatly outweighed by its advantageous aesthetic qualities. In addition, there is a need for such a door stop arrangement, particularly in the art of refrigerators, which can be incorporated without requiring alterations to the basic cabinet construction and therefore can be readily retrofitted to existing cabinets if desired.

SUMMARY OF THE INVENTION

The invention pertains to a stop arrangement for limiting the permissible range of movement of a cabinet door that is pivotally mounted, through a hinge assembly including an upper door hinge, to provide selective access to an interior cabinet compartment. More specifically, the invention pertains to a cabinet door stop arrangement constituted, at least in part, by a cover member for the upper door hinge.

In accordance with one aspect of the invention, a stop portion of the upper hinge cover member is engaged by abutment structure which is pivotally mounted for movement with the door such that the door is only permitted to open a predetermined degree due to the engagement of the abutment structure with the stop portion. In a preferred embodiment of the invention, the abutment structure is defined by another cover member that is secured upon an upper portion of the door and the stop portion defines part of a tab arranged within a cavity formed in the door cover member. With this construction, the two cover members interact to perform the stop function yet both aesthetically enhance the overall appearance of the cabinet.

In accordance with another aspect of the invention, the hinge cover member is preferably mounted for movement relative to the cabinet. This relative pivotal movement aids in providing an adequate range of movement for the door while assuring that the overall stop/covering structure is compact in nature. In accordance with the preferred embodiment, the hinge cover member is itself pivoted in direct response to engagement with a first abutment portion of the door cover member and the door is prevented from further pivotal movement when the first abutment portion of the door cover member engages the stop portion of the hinge cover member.

When used on various types of cabinets, particularly refrigerator cabinets, the door cover member can be specifically formed with symmetric end portions in order that a single, preferably molded, door cover member can be used with either left or right side hinged door arrangements. Additional features and advantages of the invention will become more readily apparent from the following detailed description of the preferred embodiment of the invention when taken in conjunction with the drawings wherein like reference numerals refer to corresponding parts in the several views.

DETAILED DESCRIPTION OF THE PREFERRED EMBODIMENT

Figure 1:
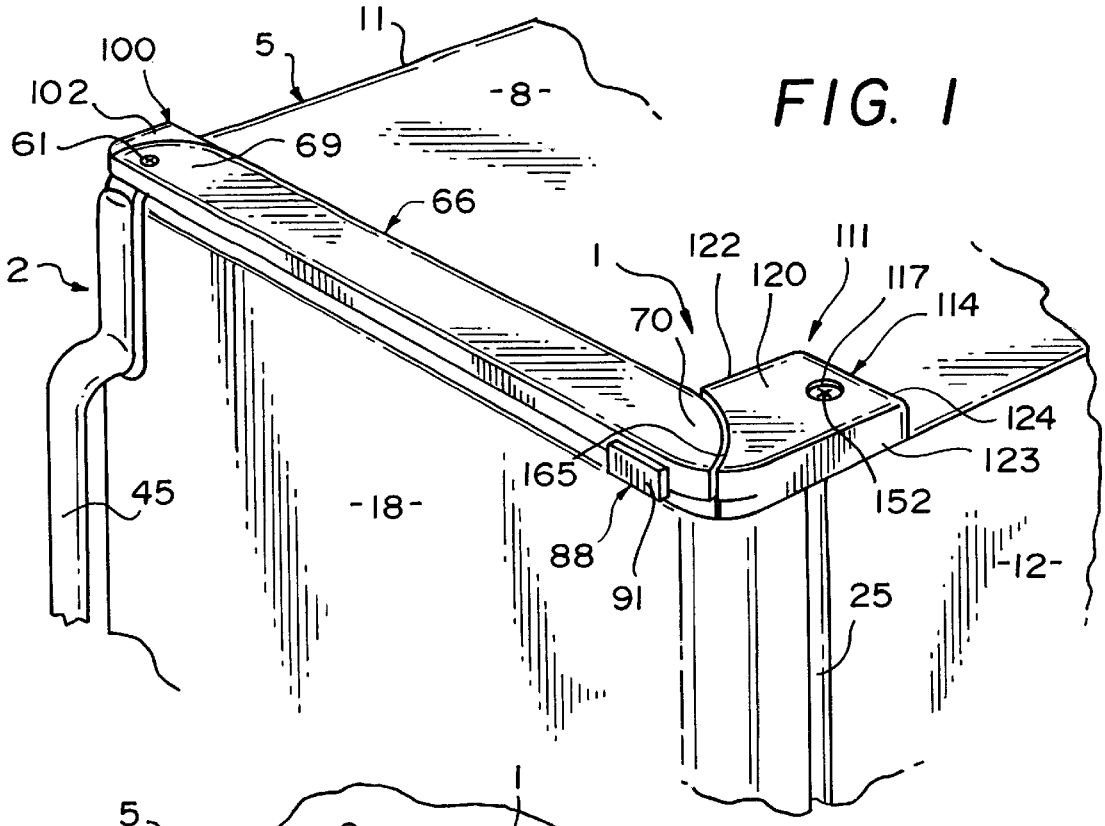
FIG. 1 is a perspective view of a top portion of a refrigerator cabinet incorporating the hinge covering door stop arrangement of the invention.
Figure 3:
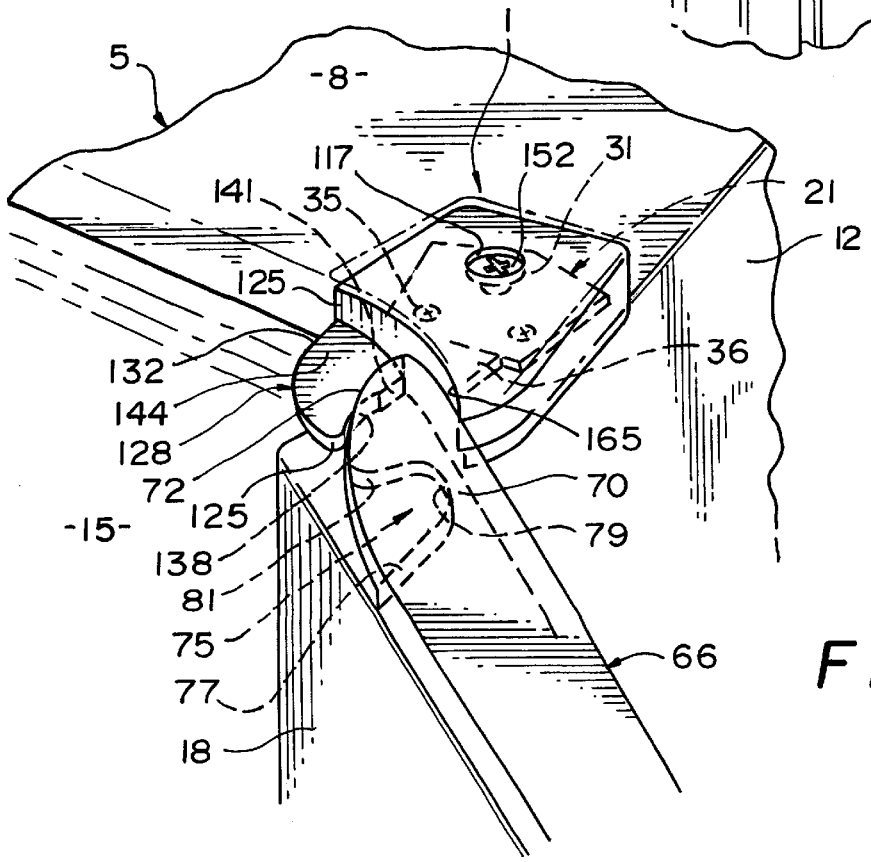
FIG. 3 is an enlarged perspective view of a corner of the top cabinet portion of FIG. 1 with a door of the cabinet shown fully opened.
Figure 2:
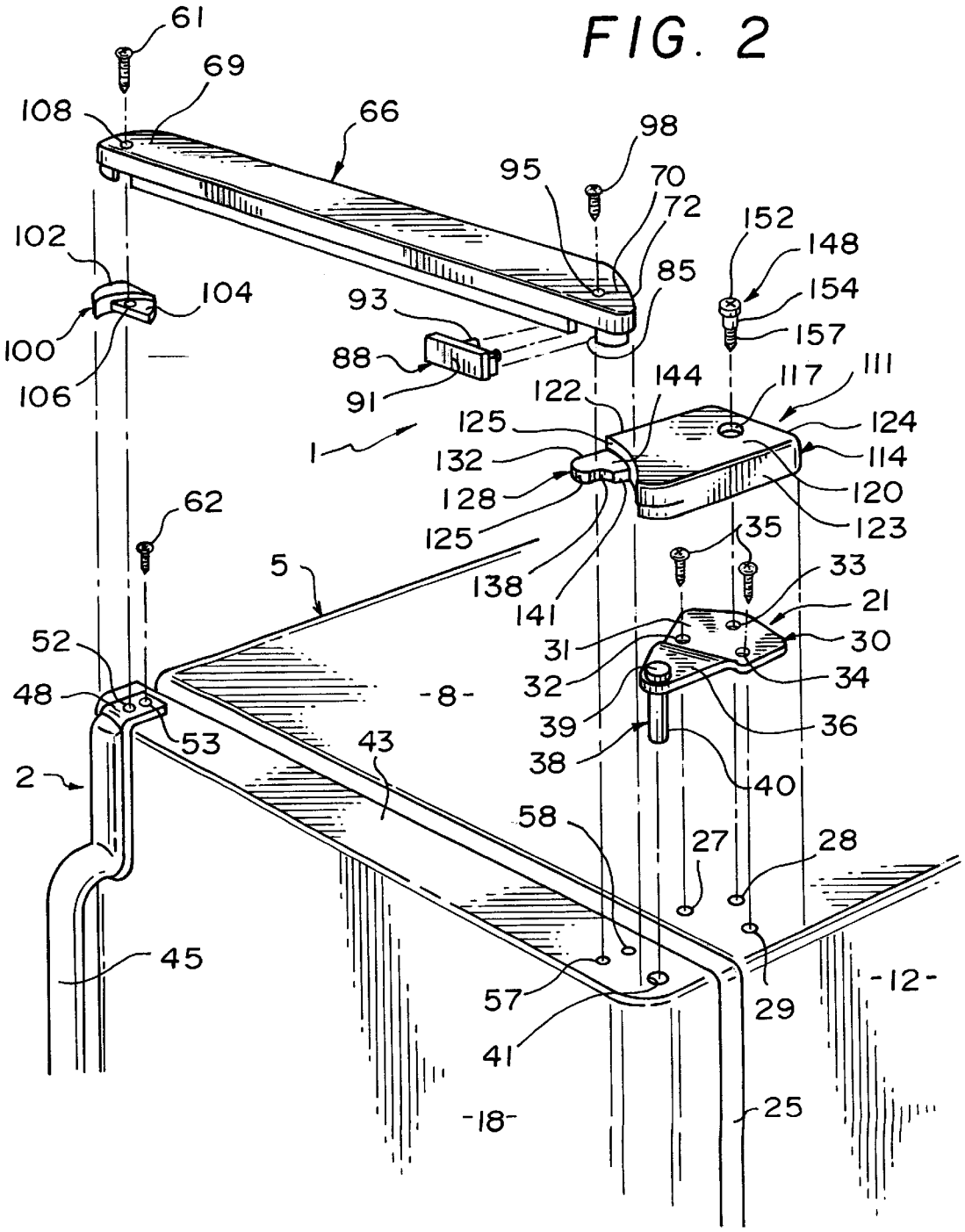
FIG. 2 is an exploded view of the hinge covering door stop arrangement of FIG. 1.

With reference to FIGS. 1–3, the articulating hinge covering door stop constructed in accordance with the preferred embodiment of the invention is generally indicated at 1 and is applied to applied to a top mount refrigerator 2. As typically known, refrigerator 2 is defined by a cabinet 5 having at least a top wall 8 and side walls 11 and 12 within which is defined a compartment 15. A door 18 is pivotally mounted to cabinet 5 in part through an upper hinge assembly indicated at 21. With such an arrangement, door 18 can be selectively shifted relative to cabinet 5 to provide selective access to compartment 15 which can comprise a fresh food or freezer compartment. An annular seal 25 is provided between door 18 and cabinet 5 in order to seal the access opening to compartment 15 in a manner widely known in the art.

As best shown in FIG. 2, top wall 8 of cabinet 5 is provided with three, generally triangularly arranged holes 27–29 for use in securing a first portion 30 of upper hinge assembly 21 to cabinet 5. More specifically, first portion 30 of upper hinge assembly 21 includes a lower plate 31 that is provided with bores 32–34 that are adapted to be aligned with holes 27–29. Lower plate 31 is affixed to top wall 8 of cabinet 5 by means of a pair of screws 35 that extend through bores 32 and 34 and are secured to top wall 8 at holes 27 and 29. In the preferred embodiment, top wall 8 and side walls 11 and 12 of cabinet 5 are made of sheet metal and therefore screws 35 are defined by sheet metal screws. First portion 30 of upper hinge assembly 21 also includes an upper plate 36 to which is secured a second portion 38 of upper hinge assembly 21. Second portion 38 generally takes the form of a pin having an enlarged head 39 that extends through an aperture (not shown) provided in upper plate 36 and a pivot axis defining shaft 40. Second portion 38 is affixed to first portion 30 by any means known in the art such as welding. At this point, it should also be readily apparent that second portion 38 could be formed integral with first portion 30. In either case, shaft 40 of second portion 38 is adapted to be received in a bore 41 extending through an upper flange portion 43 of door 18.

With this arrangement, door 18 is adapted to pivot about an axis defined by shaft 40, as well as an upright axis defined by a lower hinge assembly (which does not form part of the present invention and therefore is not shown), between open and closed positions. To facilitate opening and closing of door 18, a handle 45 is provided which has an in-turned upper end 48 formed with a pair of spaced holes 52 and 53 that are adapted to be aligned with a second pair of holes (not labeled) provided in upper flange portion 43 of door 18. Preferably, as illustrated in FIG. 2, one pair of aligned holes 57 and 58 are provided adjacent bore 41 and a second pair of aligned holes (not shown) are provided on an opposing end of upper flange portion 43 for alignment with holes 52 and 53. In general, these multiple hole pairs are provided to enable door 18 to be readily used on refrigerators with left-side or right-side hinging arrangements. In any event, in-turned end 48 of handle 45 is secured to door 18 by means of a pair of screws 61 and 62 that extend into holes 52 and 53. Up to this point in the description, the basic structure of refrigerator 2, including the pivotal mounting of door 18 and the securing of handle 45, is known in the art and therefore no additional details thereof are provided here. However, it should be readily recognized that other equivalent mounting/securing structure could also be employed in the context of the present invention. In fact, the invention need not be limited for use with a refrigerator in general.

In accordance with the preferred embodiment of the invention, articulating hinge covering door stop 1 includes an elongated first cover member 66 that is adapted to be positioned and secured upon upper flange portion 43 of door 18 in a manner which will be more fully described below. First cover member 66 includes terminal end portions 69 and 70 which, in the preferred embodiment, are symetrically constructed and therefore the particular construction of terminal end portion 70 will now be described in detail and it is understood that terminal end portion 69 is similarly constructed.

Terminal end portion 70, as best shown in FIG. 3, includes an arcuate rear surface 72 that leads to a lower recessed section or cavity 75. Recessed section 75 is generally defined by an angled first wall 77, a curved base wall 79 and an arcuate second wall 81 that merges with arcuate rear surface 72. As best shown in FIG. 2, first cover member 66 is provided with a cut-out section 85 which is adapted to receive an insert 88. Insert 88 includes an exposed portion 91 that can advantageously be provided with a manufacturer label, and an attaching portion 93 that is adapted to be snap-fit into cut-out section 85. Cut-out section 85 is aligned with a through hole 95 that is adapted to receive a screw 98 for securing terminal end portion 70 of first cover member 66 to upper flange portion 43 of door 18 at hole 57. At terminal end portion 69, a filler member 100 is provided that includes an outer plate section 102 adapted to conform with the arcuate rear surface 72 at terminal end portion 69 and an inner body section 104 having a through hole 106. Through hole 106 is adapted to be aligned with a hole 108 provided in terminal end portion 69 of first cover member 66 such that screw 61 for handle 45 can extend into hole 108 and through hole 106 in order to simultaneously secure each of terminal end portions 69 of first cover member 66, filler member 100 and handle member 45 to upper flange portion 43 of door 18. Filler member 100 is shaped to conform to the configuration of upper flange portion 43 of door 18 in combination with arcuate rear surface 72 of terminal end portion 69 in order to enhance the overall appearance of refrigerator 2.

Articulating hinge covering door stop 1 also includes a second cover member 111 having a main body portion 114 provided with a bore 117 extending through a top surface 120 thereof. Main body portion 114 also includes upstanding side walls 122 and 123, a rear wall 124 and an arcuate front wall 125. Extending from arcuate front wall 125 adjacent upstanding side wall 122 is a projecting tab 128. As clearly shown in FIGS. 1 and 3, projecting tab 128 is located below top surface 120 and includes a straight section 132 that generally constitutes an extension of upstanding side wall 122, an arcuate front section 125, a concave section 138 and a substantial linear section 141. As clearly shown in FIGS. 2 and 3, projecting tab 128 includes an upper surface 144 that is spaced below top surface 120 of main body portion 114.

In assembling articulating hinge covering door stop 1, second cover member 111 is positioned atop upper hinge assembly 21 and also extends onto a corner section (see FIG. 1) of upper flange portion 43 of door 18. Below top surface 120, main body portion 114 defines an enlarged hollow cavity (not separately labeled) within which upper hinge assembly 21 is readily received. A fastener 148 having a head 152, a shank 154 and a threaded portion 157 extends into bore 117, through bore 33 of lower plate 31 of upper hinge assembly 21 and into top wall 8 of cabinet 5. More specifically, threaded portion 157 of fastener 148 is threadably secured to top wall 8 of cabinet 5 at hole 28 while shank 154 is rotatably received within hole 33 and head 152 is rotatably received within bore 117. Due to this mounting arrangement, second cover member 111 is permitted to pivot a limited degree, defined by the space between upper hinge assembly 21 and main body portion 114 within second cover member 111, relative to cabinet 5.

After second cover member 111 is rotatably attached as described above, first cover member 66 is positioned along upper flange portion 43 of door 18 with projecting tab 128 extending into recessed section 75. Thereafter, first cover member 66 is fixedly secured to door 18 by means of screws 61 and 98. Of course, filler member 100 is also secured during this operation. Finally, insert 88 is positioned within the cut-out section 85 of first cover member 66 opposite handle 45. In the preferred embodiment shown, upper end 48 of handle 45 passes through a corresponding cut-out (not labeled but clearly shown in FIG. 2) formed in first cover member 66.

The interaction between first and second cover members 66 and 111 and the manner in which articulating hinge covering door stop 1 limits the permissible angle through which door 18 can open in accordance with the present invention will now be described with particular reference to FIG. 3. Upon opening of door 18 a slight amount, which is determined by the gap provided between terminal end portion 70 and arcuate front wall 125 of first and second cover members 66 and 111 respectively, terminal end portion 70 of first cover member 66, which defines a first abutment member in accordance with the invention, engages front wall 125 of main body portion 114 of second cover member 111 in the area of reference numeral 165. Continued opening of door 18 causes second cover member 111 to pivot about an axis defined by fastener 148 relative to cabinet 5, while terminal end portion 70 of first cover member 66 on door 18 is shifted towards projecting tab 128. When door 18 reaches the position shown in FIG. 3, terminal end portion 70 engages linear section 141 of projecting tab 128 to restrict further opening of the door 18. Therefore, linear section 141 actually defines a stop portion of second cover member 111. Upon closing of door 18 arcuate second wall 81 of first cover member 66 will engage the arcuate section 125 of projecting tab 128 to initiate the return pivoting of second cover member 111 and then arcuate second wall 81 of first cover member 66 will be positioned at concave section 138 of projecting tab 128 and this interengagement will cause second cover member 111 to rotate about the axis defined by fastener 148 to its original position shown in FIG. 1 wherein door 18 is closed.

Based on the above description, it should be readily apparent that the articulating hinge covering door stop 1 of the present invention performs the function of limiting the permissible opening degree of door 18 relative to cabinet 5 by specifically configuring the structure of the second or hinge covering member 111 and having that structure cooperate with additional structure which moves with door 18. In the preferred embodiment, this additional structure takes the form of first cover member 66 but it should be realized that door 18 itself could be constructed to directly interact with cover member 111 to perform this function. The particular mounting of cover member 111 which provides for the rotational movement thereof advantageously enables a more aesthetic and compact arrangement, such as by minimizing the spacing between first and second cover members 66 and 111.

In any event, although described with respect to a preferred embodiment of the invention, it should be readily understood that various changes and/or modifications can be made to the present invention without departing from the spirit thereof. For example, although the invention is shown for use with a top mount style refrigerator, the articulating hinge covering door stop arrangement of the present invention could be equally applied to a side-by-side style refrigerator and even other types of cabinets. In general, the invention is only intended to be limited by the scope of the following claims.

I claim:

1. In a cabinet including interconnected top and side walls which define, at least in part, an open front area that leads into an interior compartment of the cabinet and a door that is pivotally mounted for movement relative to the walls of the cabinet through a hinge assembly including an upper hinge having a first portion fixed at the top wall of the cabinet and a second, hinge axis defining portion connected to an upper portion of the door, a cover assembly comprising:

a first cover member secured upon the upper portion of the door, said first cover member including a first abutment portion; and a second cover member positioned atop said upper hinge, said second cover member including a stop portion, said stop portion being engaged by the first abutment portion of said first cover member when the door is pivoted open a predetermined amount.

2. The cover assembly according to claim 1, wherein said second cover member is pivotally mounted atop said upper hinge for movement relative to said cabinet, due to engagement with said first cover member, upon opening and closing of the door.

3. The cover assembly according to claim 2, wherein said second cover member is forced to pivot laterally outwardly of said cabinet upon opening of said door due to engagement with the first abutment portion of said first cover member and said second cover member is forced to pivot laterally inwardly of said cabinet upon closing of said door due to an engagement between a second abutment portion of said first cover member and said second cover member.

4. The cover assembly according to claim 2, wherein said second cover member is pivotally mounted to said cabinet through said upper hinge.

5. The cover assembly according to claim 2, wherein said first cover member is provided with a recessed section and said second cover member is provided with a tab, said tab being received in said recessed section when the door is closed.

6. The cover assembly according to claim 5, wherein said stop portion comprises a section of said tab.

7. The cover assembly according to claim 5, wherein said recessed section is formed in a bottom surface of said first cover member.

8. The cover assembly according to claim 2, wherein said first cover member extends across substantially the entire upper portion of the door.

9. The cover assembly according to claim 8, wherein said first cover member includes first and second laterally spaced end portions, each of said end portions being similarly constructed with a recessed section, said second cover member being provided with a tab that is adapted to be received in the recessed section formed in one of said end portions.

10. In a cabinet including interconnected top and side walls which define, at least in part, an open front area that leads into an interior compartment of the cabinet and a door that is pivotally mounted for movement relative to the walls of the cabinet through a hinge assembly including an upper hinge having a first portion fixed at the top wall of the cabinet and a second, hinge axis defining portion connected to an upper portion of the door, a cover arrangement comprising:

a hinge cover member mounted for movement relative to said cabinet, said hinge cover member extending atop and substantially entirely covering at least the first portion of said upper hinge; and means for shifting said hinge cover member relative to said upper hinge upon opening and closing of said door.

11. The cover arrangement according to claim 10, wherein said hinge cover member is pivotally mounted to said cabinet through said upper hinge.

12. The cover arrangement according to claim 10, wherein said shifting means includes a door cover member secured upon the upper portion of the door, said hinge cover member being shifted relative to said cabinet upon opening and closing of said door due to engagement between respective portions of said door and hinge cover members.

13. The cover assembly according to claim 12, wherein said hinge cover member includes a stop portion adapted to be engaged by said door cover member upon opening of the door a predetermined amount in order to limit the degree of opening of the door.

14. The cover assembly according to claim 12, wherein said hinge cover member is provided with a tab that is received within a recessed section formed in said door cover member when the door is closed.

15. The cover assembly according to claim 14, wherein said hinge cover member is pivotally mounted to said cabinet through said upper hinge.

16. The cover assembly according to claim 14, wherein said recessed section is formed in a bottom surface of said door cover member.

17. The cover assembly according to claim 12, wherein said door cover member extends across substantially the entire upper portion of the door.

18. The cover assembly according to claim 17, wherein said door cover member includes first and second laterally spaced end portions, each of said end portions being similarly constructed with a recessed section, said hinge cover member being provided with a tab that is adapted to be received in the recessed section formed in one of said end portions.

19. A method of limiting a permissible degree of angular movement of a door that is pivotally mounted through an upper hinge unit, having a first portion that is arranged substantially entirely beneath a cover member and fixed atop a top wall portion of a cabinet and a second, hinge axis defining portion connected to an upper portion of the door, from a closed position wherein the door extends across an access opening to a cabinet compartment located directly below the top wall portion of the cabinet to an open position wherein direct access to within the compartment is available, said method comprising: engaging the cover member with an element movable with the door upon a predetermined degree of opening of the door.

20. The method of limiting a permissible degree of angular movement of a door according to claim 19, further comprising: rotatably mounting the cover member for pivotal movement relative to the cabinet such that said cover member pivots upon engagement with said element.

* * * * *